US008366092B2

(12) United States Patent
Kwarta et al.

(10) Patent No.: US 8,366,092 B2
(45) Date of Patent: Feb. 5, 2013

(54) STACKING BOOKLET SHEETS ON ADJUSTABLE-ANGLE RAMP

(75) Inventors: Brian J. Kwarta, Pittsford, NY (US); Arun Chowdry, Pittsford, NY (US)

(73) Assignee: Eastman Kodak Company, Rochester, NY (US)

( * ) Notice: Subject to any disclaimer, the term of this patent is extended or adjusted under 35 U.S.C. 154(b) by 19 days.

(21) Appl. No.: 12/917,702

(22) Filed: Nov. 2, 2010

(65) Prior Publication Data

US 2011/0287917 A1 Nov. 24, 2011

Related U.S. Application Data

(60) Provisional application No. 61/347,480, filed on May 24, 2010.

(51) Int. Cl.
*B65H 37/04* (2006.01)

(52) U.S. Cl. ..... 270/21.1; 270/20.1; 270/32; 270/37; 270/58.07; 270/58.08; 270/58.11; 270/58.12; 270/58.17; 270/58.27

(58) Field of Classification Search ..... 270/20.1, 270/21.1, 32, 37, 52.17, 52.18, 58.07, 58.08, 270/58.11, 58.12, 58.17, 58.27; 271/213; 493/324, 325

See application file for complete search history.

(56) References Cited

U.S. PATENT DOCUMENTS

| | | | | |
|---|---|---|---|---|
| 4,444,491 | A | 4/1984 | Rinehart et al. | |
| 4,891,681 | A | 1/1990 | Fiske | |
| 5,108,081 | A | 4/1992 | Russel et al. | |
| 5,108,082 | A | 4/1992 | Shea et al. | |
| 6,070,023 | A * | 5/2000 | Kataoka | 399/45 |
| 6,099,225 | A | 8/2000 | Allen et al. | |
| 6,608,641 | B1 | 8/2003 | Alexandrovich et al. | |
| 7,095,526 | B1 | 8/2006 | Housel | |
| 7,762,542 | B2 * | 7/2010 | Tagawa et al. | 270/58.17 |
| 7,942,399 | B2 * | 5/2011 | Hirai et al. | 270/58.07 |
| 2005/0079968 | A1 | 4/2005 | Trovinger | |
| 2006/0133870 | A1 | 6/2006 | Ng et al. | |
| 2008/0159786 | A1 | 7/2008 | Tombs et al. | |
| 2008/0252062 | A1 | 10/2008 | Kelley | |
| 2011/0266737 | A1 * | 11/2011 | Chowdry et al. | 270/21.1 |

OTHER PUBLICATIONS

PL265 Fully Automatic Programmable Cutter, Martin Yale Industries at website, http://www. martinyale.com/product_details. aspx?SKU=Intimus%20PL215% 20&ReturnURL=%2fproduct_ listing.aspx%3fCategory%3d1579e4d1- c382-461a-9de0- 453e7a74e279% 26page%3d1%26pagesize%3d10%26 text%3d%26EPCString1%3d% 26EPCString2%3d%26 EPCString3%3d.

Cricut Personal Electronic Cutter, Provo Craft on line user manual at website http://www.cricut. com/res/mManual/CricutUserManual. pdf.

* cited by examiner

*Primary Examiner* — Leslie A Nicholson, III

(74) *Attorney, Agent, or Firm* — Christopher J. White

(57) ABSTRACT

A booklet is produced. Selectively-printed sheets are cut to length, inner sheets being shorter, and stacked on a ramp set at an adjustable angle to a sheet support. This aligns the fold axes of all the sheets so they can be fastened and folded. Gravity is used to hold the sheets in place on the ramp and sheet support.

7 Claims, 8 Drawing Sheets

STACKING BOOKLET SHEETS ON ADJUSTABLE-ANGLE RAMP

CROSS-REFERENCE TO RELATED APPLICATIONS

This application claims the priority of U.S. Provisional Application No. 61/347,480, filed May 24, 2010, the disclosure of which is incorporated herein by reference.

Reference is made to commonly assigned, co-pending U.S. patent application Ser. Nos. 12/770,095, titled "CALCULATING BOOKLET SHEET LENGTH USING TONER THICKNESS," by Chowdry, et al, 12/770,077, titled "PRODUCING BOOKLET BY CUTTING BEFORE PRINTING," by Chowdry, et al., both filed Apr. 29, 2010, and 12/777,317, titled "MAKING BOOKLET BY ITERATIVELY FOLDING AND CUTTING," by Chowdry, et al., filed May 11, 2010, the disclosures of which are incorporated by reference herein.

FIELD OF THE INVENTION

This invention pertains to the field of finishing printed sheets to produce booklets, and more particularly to such printed sheets produced using electrophotography.

BACKGROUND OF THE INVENTION

Customers of print jobs can require finishing steps for their jobs. These steps include, for example, folding printed or blank sheets, cutting sheets, trimming sheets to size and shape, cutting specialty shapes into the edges or interior of a sheet, forming multiple sheets into bound signatures or booklets, binding individual pages or signatures into books, and fastening covers to books by e.g. stapling, saddle-stitching, or gluing. Signature production requires folding a large printed sheet and cutting the folded stack so that the resulting cut pages are in sequential order.

When producing a booklet, after binding, the edges of the bound printed sheets are cut so that the edges of the individual sheets all line up (have a flush edge), as commonly seen in books, magazines, and pamphlets. When producing business cards, the cards are printed on a large sheet of stiff card stock. After printing, individual cards are produced by cutting the sheets of cards into individual business cards.

Conventional finishing equipment is typically not suited for use in consumer occupied environments such as stores or business establishments, and typically requires trained personnel to safely and effectively use it. Cutters typically include large guillotines that use heavy impacts to cut through thick stacks of paper. For example, the INTIMUS PL265 programmable cutter by MARTIN YALE of Wabash, Ind. cuts up to a 2⅞" stack of paper and weighs 823 lbs. There is a need, therefore, for smaller, lighter finishing equipment to incorporate into devices used by consumers at home or in retail environments. Furthermore, unlike offset presses which run a large number of copies of a single print job, digital printers can produce small numbers of copies of a job, requiring more frequent changes to the finishing sequence. In some cases, each printed page must be finished individually. Conventional folders, such as the RAPIDFOLD P7400 Desktop AutoFolder by MARTIN YALE, cannot finish each page individually without manual intervention. Moreover, the PL265 cutter can only store 10 cutting programs, so it cannot produce more than 10 cut patterns without manual intervention.

There is a need, therefore, for flexible and programmable finishing equipment that can finish each page individually without manual intervention.

The CRICUT cutter by PROVO CRAFT can cut shapes into individual sheets of paper. However, the machine requires manual loading and unloading. Furthermore, the CRICUT moves the sheet to be cut back and forth during cutting, making it unsuitable for high-volume applications that need continuous-speed sheet transport.

Commonly-assigned U.S. Application Publication No. 2008/0159786 to Tombs et al., the disclosure of which is incorporated herein by reference, describes printing raised information with a distinct tactile feel using electrophotographic techniques. Toner stack heights of at least 20 μm are provided.

U.S. Publication No. 2005/0079968 to Trovinger describes a sheet folding and trimming apparatus adapted to fold a sheet, trim three edges of the sheet square with the fold, and assemble the folded and trimmed sheets into a booklet. However, this apparatus requires calculating page length individually for each sheet before cutting.

Commonly-assigned U.S. Pat. No. 4,891,681 to Fiske et al., the disclosureof which is incorporated herein by reference, describes staggering the sides of sheet sets so that, upon folding, the edges become accurately aligned. Although useful, this method can be improved upon.

There is a continuing need, therefore, for a way of cutting sheets in small, customizable finishers to produce booklets with flush edges.

SUMMARY OF THE INVENTION

Applicants have discovered that when thick toner stacks are used in the fold area of prints, they can produce non-flush edges in booklets. A thick toner stack adds space between adjacent nested sheets, causing an inner sheet to protrude from an otherwise-flush booklet edge.

In accordance with an aspect of the present invention, there is provided apparatus for producing a booklet including an outer sheet and an inner sheet nested together, each sheet having a respective thickness, the outer sheet having a length in a specific direction, and a fold axis of the outer sheet being defined in the center of the outer sheet in the specific direction, the apparatus comprising:

a) a processor adapted to automatically:

i) calculate a cut length in the specific direction of the inner sheet using the respective thicknesses of the outer and inner sheets, so that when the sheets are folded and the inner sheet is nested into the outer sheet, the edges of the inner sheet will not protrude beyond the edges of the outer sheet, whereby the cut length is less than the length of the outer sheet; and ii) calculate a ramp angle using the respective thicknesses of the outer and inner sheets;

b) a cutting device for receiving the inner sheet and cutting it to the calculated cut length in the specific direction, so that a fold axis of the inner sheet is defined in the center of the inner sheet in the specific direction;

c) a stacking unit having a sheet support, and an adjustable ramp set at the calculated ramp angle to the sheet support, for receiving the outer sheet and the cut inner sheet and holding them adjacent to each other, so that the fold axis of the inner sheet and the fold axis of the outer sheet are disposed along the same normal to the sheet support; and d) a fastening unit for fastening the fold axis of the outer sheet and the fold axis of the inner sheet.

In accordance with another aspect of the present invention, there is provided a method of producing a booklet, the booklet including an outer sheet and a plurality of inner sheets nested together, each sheet having a respective thickness, the outer sheet having a length in a specific direction, and a fold axis of the outer sheet being defined in the center of the outer sheet in the specific direction, the method comprising:

providing a stacker with a sheet support and a ramp set at an adjustable ramp angle to the sheet support;

using a processor to calculate the ramp angle of the stacker using the thicknesses of the sheets, and automatically setting the ramp angle of the stacker to the calculated ramp angle;

selecting an inner sheet;

selectively printing a print image on the selected inner sheet using a print engine;

automatically folding the outer sheet along its fold axis;

using the processor to determine a cut length and a fold axis position of the selected inner sheet, so that a fold axis of the selected inner sheet is defined at the fold axis position of the inner sheet along the specific direction;

repeating the selecting through determining steps for each sheet in the booklet;

automatically stacking the outer sheet and the plurality of inner sheets on the stacker, so that the respective fold axes of all sheets are disposed along the same normal to the sheet support; and using a fastening unit to fasten the fold axes of the stacked sheets together.

An advantage of this invention is that it uses small, light, inexpensive cutting and folding machinery that can be used in environments without enough space for prior-art machines, or that require unskilled operators be able to use the machinery. The invention can emit less audible noise while operating due to its reduced power draw. It can finish each sheet of a print job individually without manual intervention. It produces flush-edged booklets, even in the presence of thick toner stacks.

BRIEF DESCRIPTION OF THE DRAWINGS

The above and other objects, features, and advantages of the present invention will become more apparent when taken in conjunction with the following description and drawings wherein identical reference numerals have been used, where possible, to designate identical features that are common to the figures, and wherein.

Figure 1:
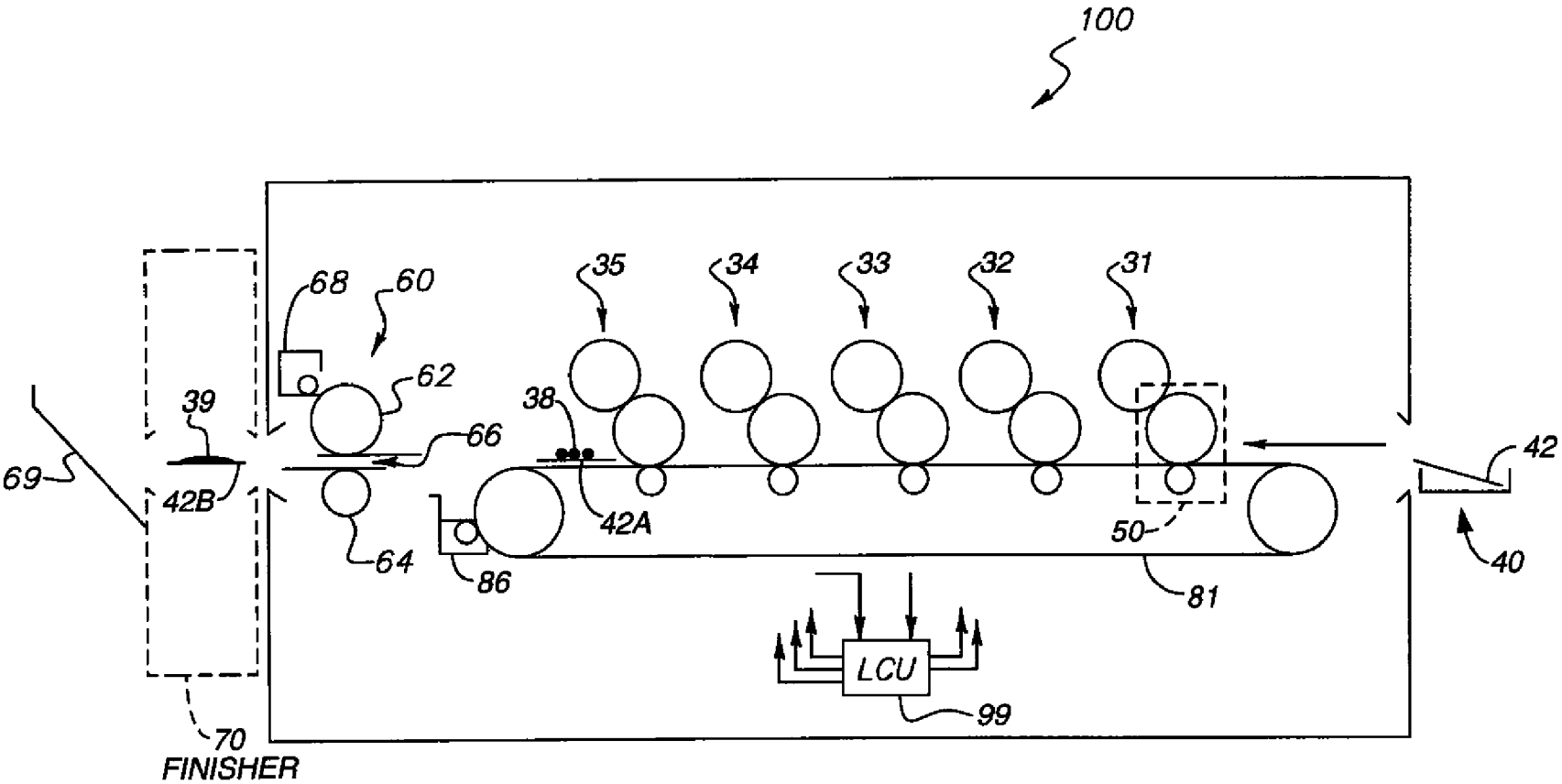
FIG. 1 is an elevational cross-section of an electrophotographic reproduction apparatus suitable for use with this invention.

The attached drawings are for purposes of illustration and are not necessarily to scale.

DETAILED DESCRIPTION OF THE INVENTION

As used herein, the terms "parallel" and "perpendicular" have a tolerance of ±10°. In preferred embodiments, components described as "parallel" or "perpendicular" are oriented to within ±0.1°. The term "center" referring to the position of a fold edge has a tolerance of ±2 mm or ±5% of the length of a sheet, whichever is greater. The term "flush" referring to edges being cut to produce a booklet with an edge in which no pages protrude beyond other pages has a tolerance of ±0.5 mm or ±1% of the length of the sheets after cutting, whichever is greater.

As used herein, "sheet" is a discrete piece of media, such as receiver media for an electrophotographic printer (described below). Sheets have a length and a width. Sheets are folded along fold axes, e.g. positioned in the center of the sheet in the length dimension, and extending the full width of the sheet. The folded sheet contains two "leaves," each leaf being that portion of the sheet on one side of the fold axis. The two sides of each leaf are referred to as "pages." "Face" refers to one side of the sheet, whether before or after folding.

In the following description, some embodiments of the present invention will be described in terms that would ordinarily be implemented as software programs. Those skilled in the art will readily recognize that the equivalent of such software can also be constructed in hardware. Because image manipulation algorithms and systems are well known, the present description will be directed in particular to algorithms and systems forming part of, or cooperating more directly with, the method in accordance with the present invention. Other aspects of such algorithms and systems, and hardware or software for producing and otherwise processing the image signals involved therewith, not specifically shown or described herein, are selected from such systems, algorithms, components, and elements known in the art. Given the system as described according to the invention in the following, software not specifically shown, suggested, or described herein that is useful for implementation of the invention is conventional and within the ordinary skill in such arts.

A computer program product can include one or more storage media, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Electrophotography is a useful process for printing images on a receiver (or "imaging substrate"), such as a piece or sheet of paper or another planar medium, glass, fabric, metal, or other objects as will be described below. In this process, an electrostatic latent image is formed on a photoreceptor by uniformly charging the photoreceptor and then discharging selected areas of the uniform charge to yield an electrostatic charge pattern corresponding to the desired image (a "latent image").

After the latent image is formed, toner particles having a charge substantially opposite to the charge of the latent image are brought into the vicinity of the photoreceptor so as to be attracted to the latent image to develop the latent image into a visible image. Note that the visible image may not be visible to the naked eye depending on the composition of the toner particles (e.g. clear toner).

After the latent image is developed into a visible image on the photoreceptor, a suitable receiver is brought into juxtaposition with the visible image. A suitable electric field is applied to transfer the toner particles of the visible image to the receiver to form the desired print image on the receiver. The imaging process is typically repeated many times with reusable photoreceptors.

The receiver is then removed from its operative association with the photoreceptor and subjected to heat or pressure to permanently fix ("fuse") the print image to the receiver. Plural print images, e.g. of separations of different colors, are overlaid on one receiver before fusing to form a multi-color print image on the receiver.

Electrophotographic (EP) printers typically transport the receiver past the photoreceptor to form the print image. The direction of travel of the receiver is referred to as the slow-scan, process, or in-track direction. This is typically the vertical (Y) direction of a portrait-oriented receiver. The direction perpendicular to the slow-scan direction is referred to as the fast-scan, cross-process, or cross-track direction, and is typically the horizontal (X) direction of a portrait-oriented receiver. "Scan" does not imply that any components are moving or scanning across the receiver; the terminology is conventional in the art.

As used herein, "toner particles" are particles of one or more material(s) that are transferred by an EP printer to a receiver to produce a desired effect or structure (e.g. a print image, texture, pattern, or coating) on the receiver. Toner particles can be ground from larger solids, or chemically prepared (e.g. precipitated from a solution of a pigment and a dispersant using an organic solvent), as is known in the art. Toner particles can have a range of diameters, e.g. less than 8 μm, on the order of 10-15 μm, up to approximately 30 μm, or larger ("diameter" refers to the volume-weighted median diameter, as determined by a device such as a Coulter Multisizer).

"Toner" refers to a material or mixture that contains toner particles and that can form an image, pattern, or coating when deposited on an imaging member including a photoreceptor, photoconductor, or electrostatically-charged or magnetic surface. Toner can be transferred from the imaging member to a receiver. Toner is also referred to in the art as marking particles, dry ink, or developer, but note that herein "developer" is used differently, as described below. Toner can be a dry mixture of particles or a suspension of particles in a liquid toner base.

Toner includes toner particles and can include other particles. Any of the particles in toner can be of various types and have various properties. Such properties can include absorption of incident electromagnetic radiation (e.g. particles containing colorants such as dyes or pigments), absorption of moisture or gasses (e.g. desiccants or getters), suppression of bacterial growth (e.g. biocides, particularly useful in liquid-toner systems), adhesion to the receiver (e.g. binders), electrical conductivity or low magnetic reluctance (e.g. metal particles), electrical resistivity, texture, gloss, magnetic remnance, florescence, resistance to etchants, and other properties of additives known in the art.

In single-component or monocomponent development systems, "developer" refers to toner alone. In these systems, none, some, or all of the particles in the toner can themselves be magnetic. However, developer in a monocomponent system does not include magnetic carrier particles. In dual-component, two-component, or multi-component development systems, "developer" refers to a mixture of toner and magnetic carrier particles, which can be electrically-conductive or -non-conductive. Toner particles can be magnetic or non-magnetic. The carrier particles can be larger than the toner particles, e.g. 20-300 μm in diameter. A magnetic field is used to move the developer in these systems by exerting a force on the magnetic carrier particles. The developer is moved into proximity with an imaging member or transfer member by the magnetic field, and the toner or toner particles in the developer are transferred from the developer to the member by an electric field, as will be described further below. The magnetic carrier particles are not intentionally deposited on the member by action of the electric field; only the toner is intentionally deposited. However, magnetic carrier particles, and other particles in the toner or developer, can be unintentionally transferred to an imaging member. Developer can include other additives known in the art, such as those listed above for toner. Toner and carrier particles can be substantially spherical or non-spherical.

The electrophotographic process can be embodied in devices including printers, copiers, scanners, and facsimiles, and analog or digital devices, all of which are referred to herein as "printers." Various aspects of the present invention are useful with electrostatographic printers such as electrophotographic printers that employ toner developed on an electrophotographic receiver, and ionographic printers and copiers that do not rely upon an electrophotographic receiver. Electrophotography and ionography are types of electrostatography (printing using electrostatic fields), which is a subset of electrography (printing using electric fields).

A digital reproduction printing system ("printer") typically includes a digital front-end processor (DFE), a print engine (also referred to in the art as a "marking engine") for applying toner to the receiver, and one or more post-printing finishing system(s) (e.g. a UV coating system, a glosser system, or a laminator system). A printer can reproduce pleasing black-and-white or color onto a receiver. A printer can also produce selected patterns of toner on a receiver, which patterns (e.g. surface textures) do not correspond directly to a visible image. The DFE receives input electronic files (such as Postscript command files) composed of images from other input devices (e.g., a scanner, a digital camera). The DFE can include various function processors, e.g. a raster image processor (RIP), image positioning processor, image manipulation processor, color processor, or image storage processor. The DFE rasterizes input electronic files into image bitmaps for the print engine to print. In some embodiments, the DFE permits a human operator to set up parameters such as layout, font, color, paper type, or post-finishing options. The print engine takes the rasterized image bitmap from the DFE and renders the bitmap into a form that can control the printing process from the exposure device to transferring the print image onto the receiver. The finishing system applies features such as protection, glossing, or binding to the prints. The finishing system can be implemented as an integral component of a printer, or as a separate machine through which prints are fed after they are printed.

The printer can also include a color management system which captures the characteristics of the image printing process implemented in the print engine (e.g. the electrophotographic process) to provide known, consistent color reproduction characteristics. The color management system can also provide known color reproduction for different inputs (e.g. digital camera images or film images).

In an embodiment of an electrophotographic modular printing machine useful with the present invention, e.g. the NEXPRESS 2100 printer manufactured by Eastman Kodak Company of Rochester, N.Y., color-toner print images are made in a plurality of color imaging modules arranged in tandem, and the print images are successively electrostatically transferred to a receiver adhered to a transport web moving through the modules. Colored toners include colorants, e.g. dyes or pigments, which absorb specific wavelengths of visible light. Commercial machines of this type typically employ intermediate transfer members in the respective modules for the transfer to the receiver of individual print images. Of course, in other electrophotographic printers, each print image is directly transferred to a receiver.

Electrophotographic printers having the capability to also deposit clear toner using an additional imaging module are also known. The provision of a clear-toner overcoat to a color print is desirable for providing protection of the print from fingerprints and reducing certain visual artifacts. Clear toner uses particles that are similar to the toner particles of the color development stations but without colored material (e.g. dye or pigment) incorporated into the toner particles. However, a clear-toner overcoat can add cost and reduce color gamut of the print; thus, it is desirable to provide for operator/user selection to determine whether or not a clear-toner overcoat will be applied to the entire print. A uniform layer of clear toner can be provided. A layer that varies inversely according to heights of the toner stacks can also be used to establish level toner stack heights. The respective color toners are deposited one upon the other at respective locations on the receiver and the height of a respective color toner stack is the sum of the toner heights of each respective color. Uniform stack height provides the print with a more even or uniform gloss.

FIG. 1 is an elevational cross-section showing portions of a typical electrophotographic printer 100 useful with the present invention. Printer 100 is adapted to produce images, such as single-color (monochrome), CMYK, or pentachrome (five-color) images, on a receiver (multicolor images are also known as "multi-component" images). Images can include text, graphics, photos, and other types of visual content. One embodiment of the invention involves printing using an electrophotographic print engine having five sets of single-color image-producing or -printing stations or modules arranged in tandem, but more or less than five colors can be combined on a single receiver. Other electrophotographic writers or printer apparatus can also be included. Various components of printer 100 are shown as rollers; other configurations are also possible, including belts.

Referring to FIG. 1, printer 100 is an electrophotographic printing apparatus having a number of tandemly-arranged electrophotographic image-forming printing modules 31, 32, 33, 34, 35, also known as electrophotographic imaging subsystems. Each printing module produces a single-color toner image for transfer using a respective transfer subsystem 50 (for clarity, only one is labeled) to a receiver 42 successively moved through the modules. Receiver 42 is transported from supply unit 40, which can include active feeding subsystems as known in the art, into printer 100. In various embodiments, the visible image can be transferred directly from an imaging roller to a receiver, or from an imaging roller to one or more transfer roller(s) or belt(s) in sequence in transfer subsystem 50, and thence to a receiver. The receiver is, for example, a selected section of a web of, or a cut sheet of, planar media such as paper or transparency film.

Each receiver, during a single pass through the five modules, can have transferred in registration thereto up to five single-color toner images to form a pentachrome image. As used herein, the term "pentachrome" implies that in a print image, combinations of various of the five colors are combined to form other colors on the receiver at various locations on the receiver, and that all five colors participate to form process colors in at least some of the subsets. That is, each of the five colors of toner can be combined with toner of one or more of the other colors at a particular location on the receiver to form a color different than the colors of the toners combined at that location. In an embodiment, printing module 31 forms black (K) print images, 32 forms yellow (Y) print images, 33 forms magenta (M) print images, and 34 forms cyan (C) print images.

Printing module 35 can form a red, blue, green, or other fifth print image, including an image formed from a clear toner (i.e. one lacking pigment). The four subtractive primary colors, cyan, magenta, yellow, and black, can be combined in various combinations of subsets thereof to form a representative spectrum of colors. The color gamut or range of a printer is dependent upon the materials used and process used for forming the colors. The fifth color can therefore be added to improve the color gamut. In addition to adding to the color gamut, the fifth color can also be a specialty color toner or spot color, such as for making proprietary logos or colors that cannot be produced with only CMYK colors (e.g. metallic, fluorescent, or pearlescent colors), or a clear toner.

Receiver 42A is shown after passing through printing module 35. Print image 38 on receiver 42A includes unfused toner particles.

Subsequent to transfer of the respective print images, overlaid in registration, one from each of the respective printing modules 31, 32, 33, 34, 35, the receiver is advanced to a fuser 60, i.e. a fusing or fixing assembly, to fuse the print image to the receiver. Transport web 81 transports the print-image-carrying receivers to fuser 60, which fixes the toner particles to the respective receivers by the application of heat and pressure. The receivers are serially de-tacked from transport web 81 to permit them to feed cleanly into fuser 60. Transport web 81 is then reconditioned for reuse at cleaning station 86 by cleaning and neutralizing the charges on the opposed surfaces of the transport web 81.

Fuser 60 includes a heated fusing roller 62 and an opposing pressure roller 64 that form a fusing nip 66 therebetween. In an embodiment, fuser 60 also includes a release fluid application substation 68 that applies release fluid, e.g. silicone oil, to fusing roller 62. Alternatively, wax-containing toner can be used without applying release fluid to fusing roller 62. Other embodiments of fusers, both contact and non-contact, can be employed with the present invention. For example, solvent fixing uses solvents to soften the toner particles so they bond with the receiver. Photoflash fusing uses short bursts of high-frequency electromagnetic radiation (e.g. ultraviolet light) to melt the toner. Radiant fixing uses lower-frequency electromagnetic radiation (e.g. infrared light) to more slowly melt the toner. Microwave fixing uses electromagnetic radiation in the microwave range to heat the receivers (primarily), thereby causing the toner particles to melt by heat conduction, so that the toner is fixed to the receiver.

The receivers (e.g. receiver 42B) carrying the fused image (e.g. fused image 39) are transported in a series from the fuser 60 along a path either to a remote output tray 69, or back to printing modules 31, 32, 33, 34, 35 to create an image on the backside of the receiver, i.e. to form a duplex print. Receivers can also be transported to any suitable output accessory. For example, an auxiliary fuser or glossing assembly can provide a clear-toner overcoat. Printer 100 can also include multiple fusers 60 to support applications such as overprinting, as known in the art.

In various embodiments, between fuser 60 and output tray 69, receiver 42B passes through finisher 70. Finisher 70 performs various paper-handling operations, such as folding, stapling, saddle-stitching, collating, and binding.

Printer 100 includes a main printer apparatus logic and control unit (LCU) 99, which receives input signals from the various sensors associated with printer 100 and sends control signals to the components of printer 100. LCU 99 can include a microprocessor incorporating suitable look-up tables and control software executable by the LCU 99. It can also include a field-programmable gate array (FPGA), programmable logic device (PLD), microcontroller, or other digital control system. LCU 99 can include memory for storing control software and data. Sensors associated with the fusing assembly provide appropriate signals to the LCU 99. In response to the sensors, the LCU 99 issues command and control signals that adjust the heat or pressure within fusing nip 66 and other operating parameters of fuser 60 for receivers. This permits printer 100 to print on receivers of various thicknesses and surface finishes, such as glossy or matte.

Image data for writing by printer 100 can be processed by a raster image processor (RIP; not shown), which can include a color separation screen generator or generators. The output of the RIP can be stored in frame or line buffers for transmission of the color separation print data to each of respective LED writers, e.g. for black (K), yellow (Y), magenta (M), cyan (C), and red (R), respectively. The RIP or color separation screen generator can be a part of printer 100 or remote therefrom. Image data processed by the RIP can be obtained from a color document scanner or a digital camera or produced by a computer or from a memory or network which typically includes image data representing a continuous image that needs to be reprocessed into halftone image data in order to be adequately represented by the printer. The RIP can perform image processing processes, e.g. color correction, in order to obtain the desired color print. Color image data is separated into the respective colors and converted by the RIP to halftone dot image data in the respective color using matrices, which comprise desired screen angles (measured counterclockwise from rightward, the +X direction) and screen rulings. The RIP can be a suitably-programmed computer or logic device and is adapted to employ stored or computed matrices and templates for processing separated color image data into rendered image data in the form of halftone information suitable for printing. These matrices can include a screen pattern memory (SPM).

Further details regarding printer 100 are provided in U.S. Pat. No. 6,608,641, issued on Aug. 19, 2003, by Peter S. Alexandrovich et al., and in U.S. Publication No. 2006/0133870, published on Jun. 22, 2006, by Yee S. Ng et al., the disclosures of which are incorporated herein by reference.

Figure 6:
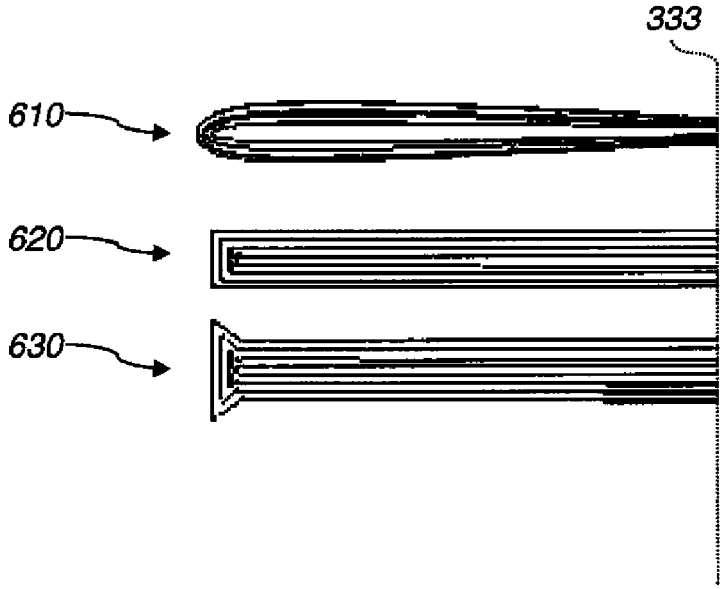
FIG. 6 shows elevational cross-sections of various booklet spine shapes useful with the present invention.

FIG. 6 shows three booklets with edges flush at edge 333. A method for producing such booklets is described herein. FIG. 6 will be discussed further below.

Figure 2:
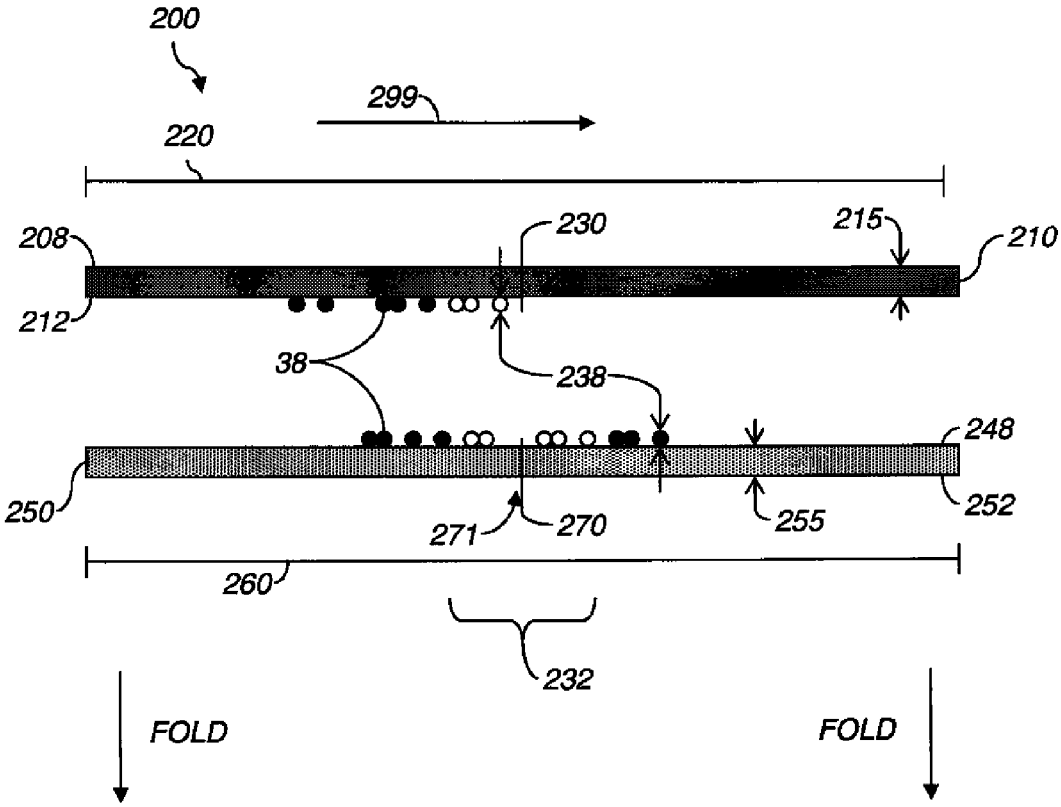
FIG. 2 is a cross-section of a booklet before folding.

FIG. 2 is a cross-section of a booklet before folding. Booklet 200 includes outer sheet 210 and a plurality of inner sheets 250 (for clarity, only one is shown here) nested together. Each sheet can be a receiver 42, as described above. Each sheet has a respective thickness 215, 255. The outer sheet 210 has a length 220 in a specific direction 299. A fold axis 230 of the outer sheet is defined in the center of outer sheet 210 in specific direction 299. Inner sheet 250 has a length 260 in the specific direction 299. A fold axis 270 of inner sheet 250 is defined at fold axis position 271 of inner sheet 250 in specific direction 299, as will be discussed further below. In an embodiment, fold axis 270 is defined in the center of the inner sheet 250 in specific direction 299.

Figure 3:
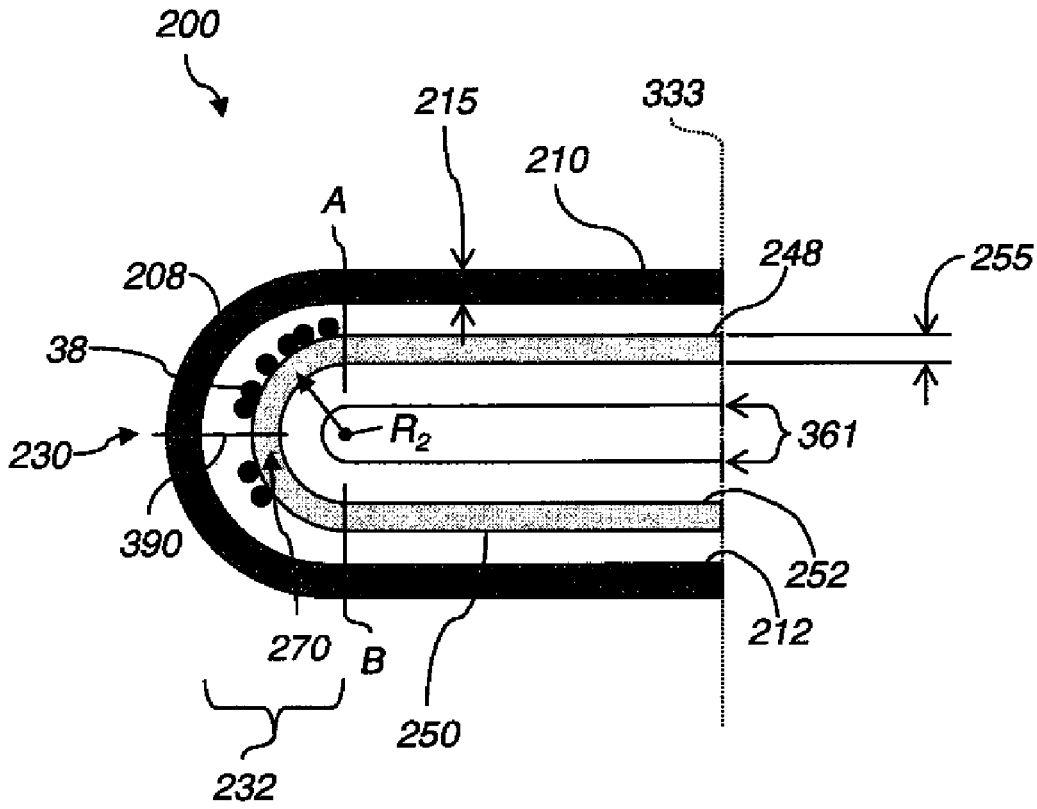
FIG. 3 is a cross-section of a folded booklet with flush edges.

The sheets will be folded in the direction marked "FOLD" to produce a booklet as shown in FIG. 3. Therefore, outer sheet 210 has an outside face 208, which will form the visible cover of the folded booklet, and an inside face 212. Inner sheet 250 has an outside face 248 and an inside face 252. Outside face 248 faces inside face 212. A fold area 232 is provided for each sheet on either side of its fold axis (e.g. fold axis 230 for outer sheet 210, fold axis 270 for inner sheet 250). In an embodiment, fold area 232 is the area that experiences plastic deformation or cracking while the respective sheet is folded. In other embodiments, fold area 232 for each sheet is the area ±1 mm or ±2 mm from the respective fold axis (e.g. 230, 270).

Print image 38 is printed on outside face 248 of inner sheet 250 or inside face 212 of outer sheet 210 using a print engine (e.g. printing module 31 of FIG. 1). In this example, print images 38 are shown on outside face 248 and inside face 212, but an image can be applied to only one or the other. This invention can be employed with simplex printing (e.g. print images 38 are applied to the outside face of each sheet) or duplex printing (e.g. print images 38 are applied to both faces of each sheet). In this example, print image 38 includes a plurality of toner particles, shown as solid and hollow circles. Each print image 38 has a thickness 238. Thickness 238 can be calculated as the average or maximum thickness of toner over the surface of the entire print image, or preferably as the average or maximum thickness of toner over fold area 232.

In an embodiment, at least a portion of print image 238 is printed in fold area 232 of a sheet, for example of a selected inner sheet 250. In this example, the toner particles composing the portion of print image 38 in fold area 232 on outer sheet 210 and inner sheet 250 are shown as hollow circles.

In an embodiment, outer sheet 210 is a cover sheet and inner sheet 250 is a sheet of content. Outer sheet 210 is thicker and stiffer than inner sheet 250.

FIG. 3 is a cross-section of a booklet with flush edges. Booklet 200 with outer sheet 210, inner sheet 250, respective thicknesses 215, 255, respective fold axes 230, 270, respective inside faces 212, 252, and respective outside faces 208, 248 are as shown in FIG. 2. Outside face 248 of inner sheet 250 is shown carrying print image 38, which can be formed electrophotographically as described above (so inner sheet 250 carries fused image 39), by wet electrophotography, by inkjet printing, by thermal dye sublimation, or by other digital printing technologies known in the art. As discussed above, inside face 212 of outer sheet 210 can also carry a print image 38 (or a fused image 39, FIG. 1). Outer sheet 210 and inner sheet 250 are held together by staple 390, which passes through both sheets.

Outer sheet 210 has a known thickness 215. Upon folding, there are formed an acute angle on the inner surface of outer sheet 210 along fold axis 230, and an obtuse angle on the outer surface of inner sheet 250 along fold axis 270. Thicknesses 215, 255 of outer sheet 210 and inner sheet 250 would cause an inner sheet 250 of similar dimensions to protrude from outer sheet 210 at edge 333, which is opposite fold axis 230 when folded. Similarly, after folding, inner sheet 250 has a narrower radius of curvature at fold axis 270 than does outer sheet 210 at fold axis 230. Therefore, less of length 260 (FIG. 2) of inner sheet 250 is taken up in the curvature at the fold (in fold area 232), so more of length 260 (FIG. 2) is taken up in the pages outside fold area 232. Moreover, print image 38 increases the minimum spacing between inner sheet 250 and outer sheet 210 by serving as spacers or standoffs. Inner sheet 250 is therefore cut slightly shorter than outer sheet 210 to maintain flush edges at edge 333 in the presence of these factors. Inner sheet therefore has cut length 361 after cutting. Cut length 361 is preferably less than length 260 (FIG. 2).

For example, with the spine shape shown in FIG. 3, the circumferential distance of any sheet through fold area 232 is approximately one-half the circumference of a circle having a radius equal to the bend radius. As shown here, inner sheet 250 has radius $R_2$ and extends from A to B through fold area 232. The length $L_2$ of inner sheet 250 through fold area 232 is therefore $$L_2=2\pi R_2/2 \quad \text{(Eq. 1)}$$

Outer sheet 210 has radius $R_1$ (for clarity, not shown), $R_1>R_2$. Therefore $L_1=2\pi R_1/2$, $L_1>L_2$. In various embodiments, cut length $c_2$ of inner sheet 250 is calculated from cut length $c_1$ (or simply length 220, FIG. 2):

$$c_2=c_1-(L_1-L_2) \quad \text{(Eq. 2)}$$

since $(L_1-L_2)$ is the extra bend circumference of outer sheet 210 compared to inner sheet 250. $(L_{260}-c_2)/2$ is then cut off each end of inner sheet 250 to make inner sheet 250 the correct length, where $L_{260}$ represents length 260 (FIG. 2).

In various embodiments, radii $R_i$ can be calculated taking the thickness of the sheet into account by calculating $R_i$ to be the center of the sheet, taken through its thickness. Thickness 238 of print image 38 on a sheet can be considered part of the thickness of that sheet, and $R_i$ calculated accordingly. For non-circular spine shapes, the distance $L_i$ of each sheet between points A and B can be calculated appropriately and the other equations above used with the calculated $L_i$ values.

Figure 4:
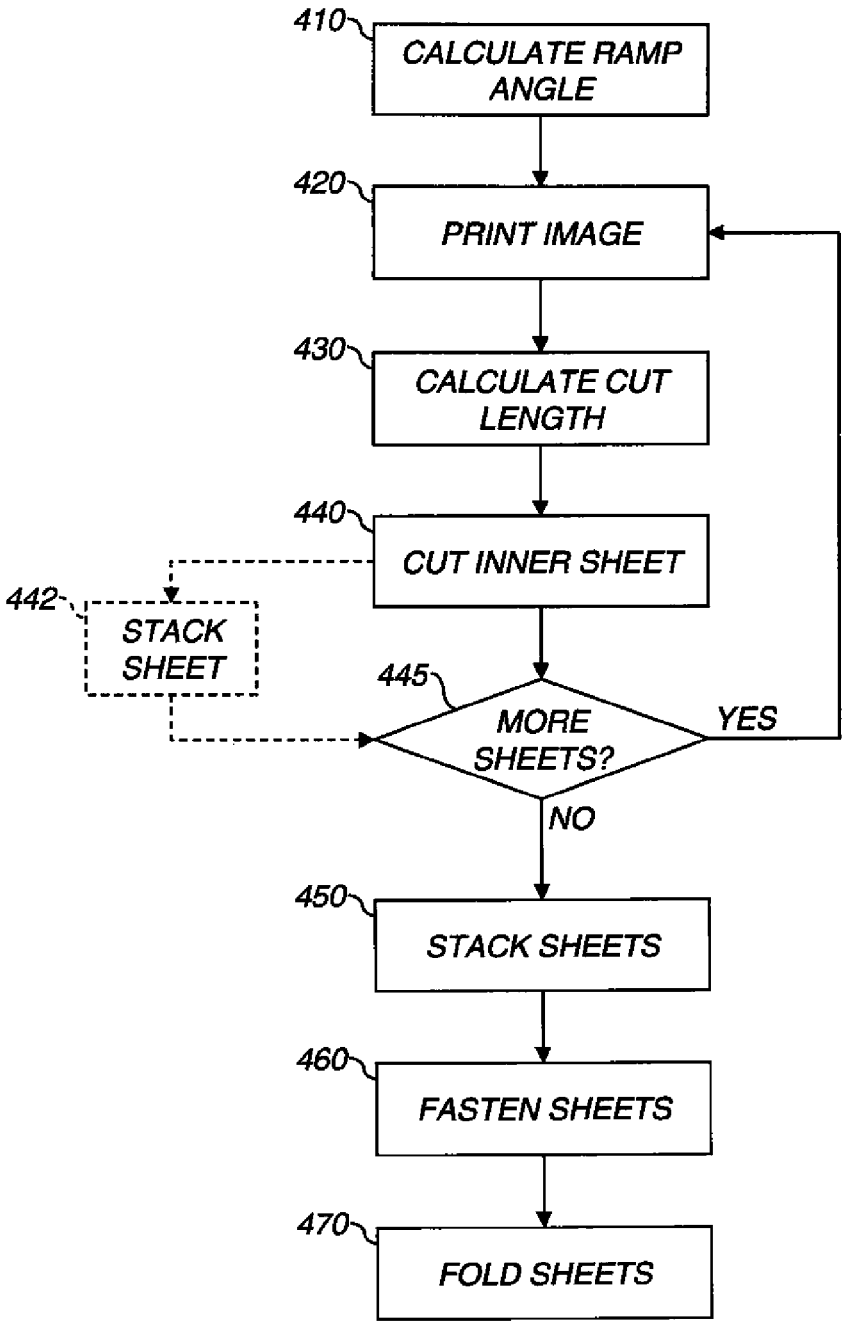
FIG. 4 is a flowchart of a booklet-making method according to an embodiment of the present invention.

Referring to FIG. 4 and also to FIG. 2, there is shown a flowchart of a booklet-making method according to an embodiment of the present invention. Processing begins with step 410. For clarity, the discussion here refers to inner sheet 250 (FIG. 2), but similar processing is used for all sheets in the booklet for which a flush edge is desired.

In step 410, the ramp angle is calculated. The stacker (stacking unit) has a sheet support and a ramp set at an adjustable ramp angle to the sheet support, as will be discussed further below. Receiver thickness, toner thickness, receiver size, and spine shape can all be used to calculate the ramp angle. For example, cut length can be calculated as described above, then ramp angle calculated from cut length and thickness as described below. Step 410 is followed by step 420.

In step 420, a print image is selectively printed on inner sheet 250 using a print engine. Not all sheets of the booklet are required to be printed; a booklet can include blank sheets (e.g. for endpapers), sheets printed only on one face, and duplex sheets (i.e. sheets printed on both faces). Each print image 38 has a thickness 238 as discussed above. Outer sheets 210 will be discussed below. Step 420 is followed by step 430.

In step 430, a processor (e.g. processor 586, FIG. 5) is used to calculate the cut length for inner sheet 250. Cut lengths can be different for outer sheets than for inner sheets. In general, each inner sheet has a unique cut length, with inner sheets closer to the inside of the booklet being cut to shorter lengths than inner sheets closer to the outside of the booklet. The cut length is correlated with fold axis position 271 of inner sheet 250, which the processor also calculates. Fold axis 270 of inner sheet 250 is thus defined at fold axis position 271 of inner sheet 250 along the specific direction 299. Step 430 is followed by step 440. Fold axis 270 can be in the center of inner sheet 250, or adjustable or selectable based on page length, user input, or job preferences. For example, inner sheet 250 can be folded slightly less than halfway across in specific direction 299 to provide a booklet that protrudes on one edge for marketing purposes.

In step 440, inner sheet 250 is cut to the selected cut length. Step 440 is followed by decision step 445.

Decision step 445 decides whether there are more inner sheets 250 to add to the booklet. If so, the next step is step 420. Steps 420-440 are repeated for all inner sheets 250. In this way, booklet 200 is produced having more than two sheets. When there are no more sheets to print and cut, the next step is step 450.

In step 450, the inner sheets 250 are stacked. In an alternative embodiment, each inner sheet 250 can be stacked after it is cut (step 442, in between steps 440 and 445). Step 450 is followed by step 460. Inner sheets 250 are stacked on the ramp in order either from inside to out or from outside to in. Inner sheets 250 are preferably held in place on the ramp by gravity, and are held at an angle of at least than 45° above the horizontal.

In step 460, a fastening unit is used to fasten the fold axes of the nested inner sheets 250 and any outer sheet(s) 210 together along the fold axis. Stapling, saddle-stitching, saddle-sewing, and other center-fastening operations can be used. Various fastening machines known in the art can be employed. For example, an electromechanical stapler can press staples through the booklets into an anvil. An exemplary stapler useful with the present invention is shown in U.S. Pat. No. 4,444,491 to Rinehart et al., issued Apr. 24, 1984, the disclosures of which are incorporated herein by reference. An exemplary saddle stitcher useful with the present application is shown in commonly-assigned U.S. Pat. No. 5,108,081 to Russel et al.

Step 460 is followed by step 470. In step 470, the sheets are automatically folded along the fold axis to produce a booklet. A spine shape (FIG. 6) can also be applied, in which case the fastening and folding steps produce the desired spine shape. In an embodiment, folding unit 520 (FIG. 5) is used to fold the booklet. Other folders known in the art can also be used with this invention.

In various embodiments, these steps can be performed in various orders. Cutting, printing, folding, stacking, nesting, and fastening can be ordered as desired, and can be performed for one sheet or more than one sheet at a time, as long as the sheets are cut (e.g. step 440) before stacking (e.g. steps 442 or 450) and stacked before fastening or folding (e.g. steps 460 or 470).

FIG. 6 shows elevational cross-sections of various booklet spine shapes useful with the present invention. Spine shape 610 is a rounded spine, e.g. for a saddle-stitched booklet. Spine shape 620 is a squared spine, useful for producing the look of perfect binding without requiring a perfect-binding machine. Spine shape 630 is a spine that bulges out at the end, here in an angular fashion, although a rounded or mushroom-shaped bulge can be produced. The bulge permits easier gripping of the booklet, and permits the booklet to lie more flat when opened. Other spine shapes can also be employed. All three booklets shown have flush edges at edge 333.

Referring also to FIG. 2, in various embodiments, folding step 470 (FIG. 4) applies a selected spine shape (e.g. 610, 620, 630) to the inner sheet(s) 250 and any outer sheet 210. Each spine shape has a different mapping of sheet position in the booklet to cut length 361. For example, the difference in lengths between sheets can be smaller using spine shape 610 than using spine shape 620, because when using spine shape 620, the outer sheets have to travel two sides of a triangle instead of (approximately) its hypotenuse. The cut length of inner sheet 250 is calculated to produce a flush booklet for any spine shape.

Figure 7:
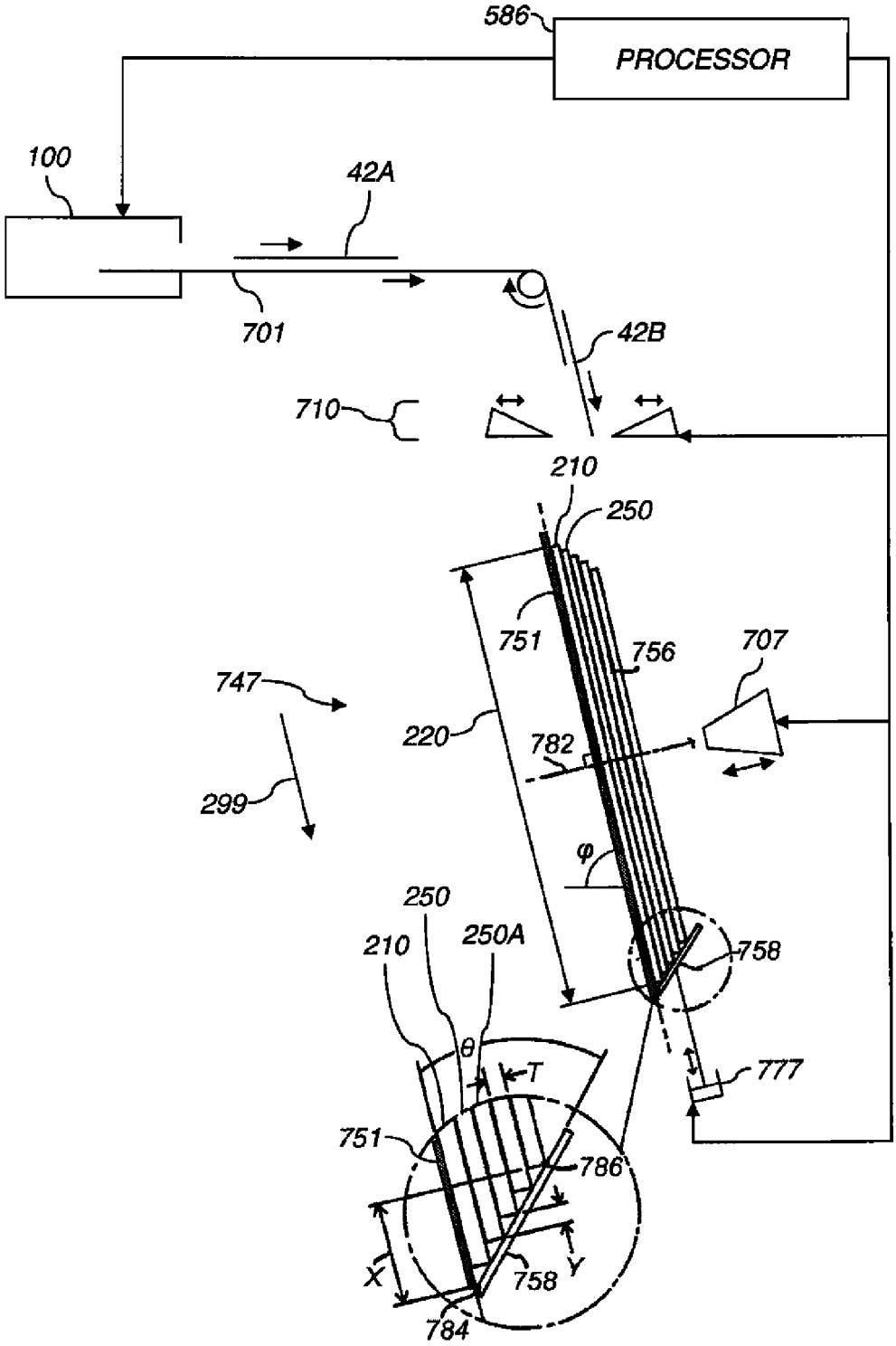
FIG. 7 shows an elevation of booklet-making apparatus according to an embodiment of the present invention.

FIG. 7 is an elevation of apparatus according to an embodiment. The apparatus produces a booklet including an outer sheet 210 and an inner sheet 250 nested together. Several other sheets are shown here nested on inner sheet 250, but only two sheets are required. Each sheet has a respective thickness T. Outer sheet 250 has a length 220 in a specific direction 299, and a fold axis 230 (FIG. 2) of outer sheet 250 is defined in the center of outer sheet 250 in direction 299.

Processor 586 is adapted to automatically calculate a cut length in direction 299 of inner sheet 250 using the thicknesses of the sheets T, so that when the sheets are folded and inner sheet 250 is nested into outer sheet 210, the edges of inner sheet 250 will not protrude beyond the edges of outer sheet 210, whereby the cut length is less than the length 220 of outer sheet 250. Processor 586 further calculates a ramp angle θ using the thicknesses of the sheets, as will be described further below. Processor 586 is a general-purpose processor, CPU, FPGA, PLD, PAL, or ASIC programmed to sequence the operations of the printer and finisher, and provide control signals to various components, and calculate parameters such as ramp angle θ.

Printer 100 prints sheets (e.g. receiver 42A) and transports them on belt 701. Belt 701 carries the sheets to cutting device 710; receiver 42B is shown in position to be cut at its leading edge. Cutting device 710 receives inner sheet 250 (e.g. receiver 42B) and cuts it to the cut length in direction 299 calculated by processor 586, so that a fold axis 230 (FIG. 2) of inner sheet 250 is defined in the center of inner sheet 250 in specific direction 299. Cutting device 710 is shown here as an automatic scissor (two blades moving towards each other to cut); guillotines, pizza-wheel (rotary) cutters, saws, and other cutting devices known in the art can also be used.

Stacking unit 747 includes sheet support 751 for holding the sheets. Sheet support 751 preferably extends in a direction making an angle ϕ having a magnitude less than 90° with the horizontal on the side away from the sheets (ϕ<90°), so that the sheets are held by gravity against sheet support 751. Adjustable ramp 758 is set at ramp angle θ to the sheet support, θ being the ramp angle calculated by processor 586. Angle θ is adjusted by actuator 777 (e.g. a piston driving a rod, as shown, or a motor driving a cam moving a camshaft) under control of processor 586. Ramp 758 receives outer sheet 210 and cut inner sheet 250 and holds them adjacent to each other, so that fold axis 270 (FIG. 2) of inner sheet 250 and fold axis 230 (FIG. 2) of outer sheet 210 are disposed along the same normal 782 to sheet support 751. "Along the same normal" has a tolerance determined by the tolerances of the fastening unit. Examples of tolerances can include ±1% or ±5% of the sheet length, ±1 mm, or ±2 mm.

Fastening unit 707 fastens 230 of outer sheet 210 and fold axis 270 (FIG. 2) of inner sheet 250 along normal 782. Fastening unit 707 can be a stapler, stitcher, tacker, or other fastening devices known in the art. Fastening unit 707 can press into the stack 756 of sheets and apply a fastener.

In an embodiment, printer 100 applies print image 38 (FIG. 2) to inner sheet 250 or outer sheet 210, and processor 586 calculates the cut length or the ramp angle θ additionally using the thickness 238 (FIG. 2) of print image 38. Print image thickness 238 is added to sheet thickness T when calculating the cut length or the ramp angle θ. The remaining calculations are performed as described below.

Referring to the inset view of ramp 758, each sheet has thickness T. As discussed above, in an embodiment T includes print image thickness 238. The offset Y between each adjacent pair of sheets (here, inner sheets 250, 250A) is one-half the difference between the length of the longer sheet (here, the cut length $c_1$ of inner sheet 250) and the length of the shorter sheet (here, the cut length $c_2$ of inner sheet 250A). Xis thelength in direction 299 of stack 756, which contains N sheets (here, N=5), i.e. the distance between points 784 and 786 in direction 299.

Then $$\theta=\tan^{-1}(N\cdot T/X) \quad \text{(Eq. 3)}$$

or, alternatively, $$\theta=\tan^{-1}(T/Y) \quad \text{(Eq. 4)}$$

where $$Y=(c_2-c_1)/2 \quad \text{(Eq. 5)}$$

Processor 586 uses these equations to calculate the appropriate ramp angle θ for the given thicknesses and cut lengths. This permits processor 586 to produce a flush-edged booklet in the presence of different spine shapes and different thicknesses.

In various embodiments, each sheet i has a respective $T_i$, and at least two sheets j, k have different thicknesses ($T_j \neq T_k$). A respective $\theta_i$ is calculated for each sheet, and the ramp angle θ is selected as the average, rms value, minimum, maximum, median, or mode of all the $T_i$ values.

In another embodiment, stacking unit 747 or a component thereof is shaken or vibrated while sheets are being stacked. This permits the sheets to settle completely against ramp 758 under the influence of gravity, even in the presence of friction between the existing top sheet of the stack and the new sheet being added to the top of the stack.

Figure 5:
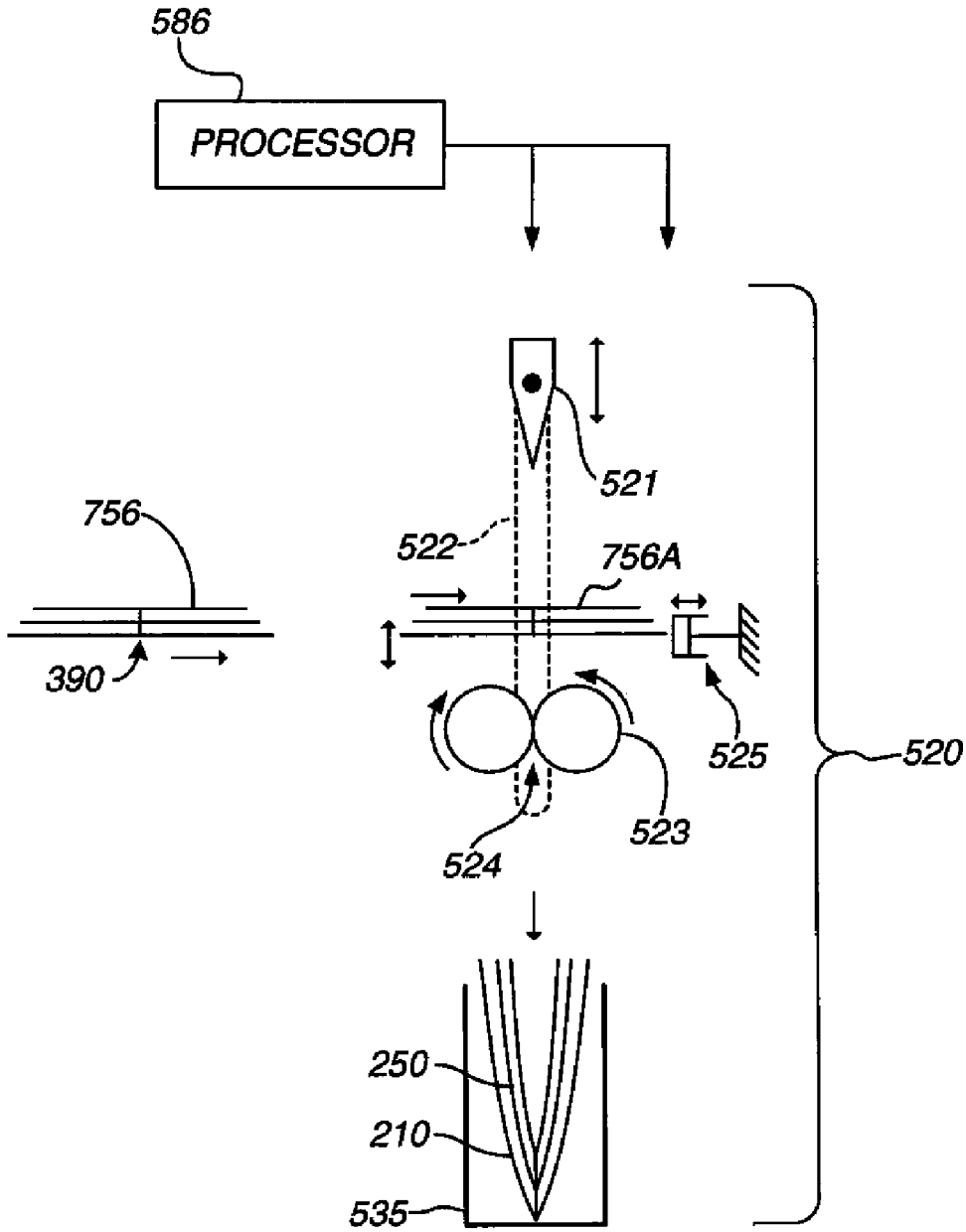
FIG. 5 is an elevation of a folding apparatus according to an embodiment of the present invention.

FIG. 5 is an elevation of a folding apparatus according to an embodiment of the present invention. In an embodiment, to the apparatus shown in FIG. 7 is added a folding unit 520 for automatically folding the printed sheets along their respective fold axes after fastening. Stack 756, fastened with staple 390, is shown entering the folding unit 520.

Folder 520 includes blade 521 riding in track 522 to press stack into rollers 523. Stack 756A is positioned over rollers 523 and held in place by a belt, transport roller, vacuum chuck or other retention mechanism. Adjustable paper stop 525 positions the center of stack 756A (e.g. fold axis 270 of inner sheet 250) under the point of blade 521. Blade 521 slides down track 522 and presses stack 756A into nip 524 formed between rollers 523. Rollers 523 rotate to take up stack 756A into nip 524, so that each sheet in stack 756A is folded by being pinched and creased between rollers 523. Blade 521 then rides back down track 522. Rollers 523 continue turning and stack 756A falls out of the folder into holder 535, which is positioned below nip 524 of rollers 523 to collect stacks falling from nip 524. Outer sheet 210 and inner sheet 250 are shown in exaggerated size in holder 535 to more clearly show the invention. In another embodiment, a buckle folder can be employed with the present invention. An exemplary buckle folder useful with the present application is shown in commonly-assigned U.S. Pat. No. 5,108,082 to Shea et al.

In various embodiments, processor 586 causes paper stop 525 to be positioned so that the leading edge (here, the right-hand edge) of outer sheet 210 of stack 756A is stopped at the appropriate position relative to the center of stack 756A and to the centerline of blade 521. This permits sheets and stacks of various sizes to be accommodated. For example, to fold stack 756A, paper stop 525 is positioned so that the leading edge of outer sheet 210 of stack 756A stops at a position equal to the centerline of blade 521 (extended through receiver 42A) plus one-half of length 220 (FIG. 2). This positions fold axis 270 of inner sheet 250 (and, in fact, all of stack 756A, within tolerances) on the extended centerline of blade 521, below blade 521 and above nip 524. When blade 521 travels down, it contacts inner sheet 250 (here, receiver 42A) at fold axis 270, folding inner sheet 250 and stack 756A in the desired location.

Blade 521, rollers 523, and paper stop 525 are driven by motors, e.g. servo motors or stepper motors, or actuators, e.g. linear piezoelectric actuators or solenoids (not shown), which can be selected by those skilled in the art, and can be belt- or chain-driven. Processor 586 provides control signals to the motors, as indicated by the arrows on the figure. Processor 586 can be part of LCU 99 (FIG. 1) or a separate processor.

Figure 8:
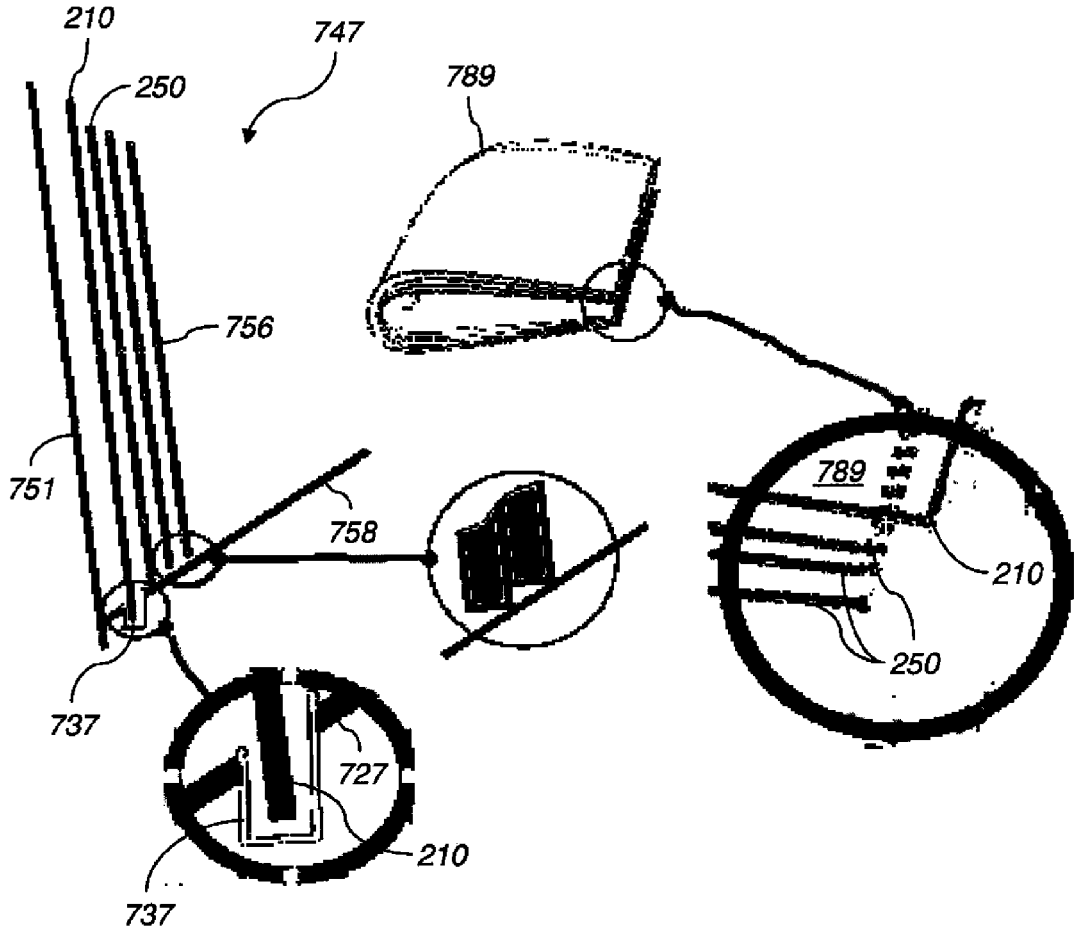
FIG. 8 shows a stacking unit according to an embodiment of the present invention.

FIG. 8 shows a stacking unit 747 according to an embodiment of the present invention. Sheet support 751 is as shown in FIG. 7. Ramp 758 includes notch 737 and non-notch surface 727, and holds stack 756. In this embodiment, finished booklet 789 has flush-edged inner sheets 250, but outer sheet 210 protrudes beyond edge 333 (FIG. 3), where inner sheet(s) 250 stop. While stacking, outer sheet 210 nests into notch 737, but all the inner sheet(s) 250 sit on non-notch surface 727. This permits a much larger difference between length 220 of outer sheet 210 and cut length 361 of inner sheet 250 than is permissible without the notch. Ramp angle θ is calculated only for inner sheet(s) 250, ignoring outer sheet 210. The effect of this embodiment is shown as booklet 789.

In an embodiment, the depth of notch 737 is adjustable to permit outer sheets of various lengths to be used. The depth of notch 737 is adjusted so that fold axis 230 of outer sheet 210 is on normal 782.

The invention is inclusive of combinations of the embodiments described herein. References to "a particular embodiment" and the like refer to features that are present in at least one embodiment of the invention. Separate references to "an embodiment" or "particular embodiments" or the like do not necessarily refer to the same embodiment or embodiments; however, such embodiments are not mutually exclusive, unless so indicated or as are readily apparent to one of skill in the art. The use of singular or plural in referring to the "method" or "methods" and the like is not limiting. The word "or" is used in this disclosure in a non-exclusive sense, unless otherwise explicitly noted.

The invention has been described in detail with particular reference to certain preferred embodiments thereof, but it will be understood that variations, combinations, and modifications can be effected by a person of ordinary skill in the art within the spirit and scope of the invention.

PARTS LIST

31, 32, 33, 34, 35 printing module
38 print image
39 fused image
40 supply unit
42, 42A, 42B, receiver
50 transfer subsystem
60 fuser
62 fusing roller
64 pressure roller
66 fusing nip
68 release fluid application substation
69 output tray
70 finisher
81 transport web
86 cleaning station
99 logic and control unit (LCU)
100 printer
200 booklet
208 outside face
210 outer sheet
212 inside face
215 thickness
220 length
230 fold axis
232 fold area
238 thickness
248 outside face
250, 250A, inner sheet
252 inside face
255 thickness
260 length
270 fold axis
271 fold axis position
299 direction
333 edge
361 cut length
390 staple
410 calculate ramp angle
420 print image step
430 calculate cut length
440 cut inner sheet
442 stack sheet
445 decision step
450 stack sheets
460 fasten sheets
470 fold sheets
520 folding unit
521 blade
522 track
523 rollers
524 nip
525 paper stop
535 holder
586 processor
610, 620, 630 spine shape
701 belt
707 fastening unit
710 cutting device
727 surface
737 notch
747 stacking unit
751 sheet support
756, 756A stack
758 ramp
777 actuator
782 normal
784 point
786 point
789 booklet
θ ramp angle
ϕ angle
$R_2$ radius
T thickness
Y offset

The invention claimed is:

1. Apparatus for producing a booklet including an outer sheet and an inner sheet nested together, each sheet having a respective thickness, the outer sheet having a length in a specific direction, and a fold axis of the outer sheet being defined in the center of the outer sheet in the specific direction, the apparatus comprising:

a) a processor adapted to automatically:

i) receive an indication of a spine shape of the booklet;

ii) calculate a cut length in the specific direction of the inner sheet using the respective thicknesses of the outer and inner sheets and the received indication of the spine shape, so that when the sheets are folded and the inner sheet is nested into the outer sheet, the edges of the inner sheet will not protrude beyond the edges of the outer sheet, whereby the cut length is less than the length of the outer sheet; and iii) calculate a ramp angle using the respective thicknesses of the outer and inner sheets;

b) a cutting device for receiving the inner sheet and cutting it to the calculated cut length in the specific direction, so that a fold axis of the inner sheet is defined in the center of the inner sheet in the specific direction;

c) a stacking unit responsive to the processor and having a sheet support, and an adjustable ramp set at the processor-calculated ramp angle to the sheet support, for receiving the outer sheet and the cut inner sheet and holding them adjacent to each other, so that the fold axis of the inner sheet and the fold axis of the outer sheet are disposed along the same normal to the sheet support; and d) a fastening unit for fastening the fold axis of the outer sheet and the fold axis of the inner sheet.

2. The apparatus according to claim 1, further including a folding unit for automatically folding the printed sheets along their respective fold axes after fastening.

3. The apparatus according to claim 1, further including a printer for applying a print image to the inner sheet or the outer sheet, wherein the processor calculates the cut length or the ramp angle additionally using the thickness of the print image.

4. Apparatus for producing a booklet including an outer sheet and a plurality of inner sheets nested together, each sheet having a respective thickness, the outer sheet having a length in a specific direction, and a fold axis of the outer sheet being defined in the center of the outer sheet in the specific direction, the apparatus comprising:

a) a processor adapted to automatically:

i) calculate a respective cut length in the specific direction for each of the inner sheets using the respective thicknesses of the outer sheet and the inner sheets, so that when the sheets are folded and the inner sheets are nested into the outer sheet, the edges of the inner sheets will not protrude beyond the edges of the outer sheet, whereby each respective cut length is less than the length of the outer sheet; and ii) calculate a ramp angle using the respective thicknesses of the inner sheets;

b) a cutting device for receiving each inner sheet and cutting it to the respective calculated cut length in the specific direction, so that a respective fold axis of each inner sheet is defined in the center of the inner sheet in the specific direction;

c) a stacking unit having a sheet support, and an adjustable ramp set at the calculated ramp angle to the sheet support, the ramp including a notch for receiving the outer sheet and a non-notch surface for receiving the cut inner sheets, wherein the ramp holds the outer and inner sheets adjacent to each other, so that the fold axes of the inner sheets and the fold axis of the outer sheet are disposed along the same normal to the sheet support; and d) a fastening unit for fastening the fold axis of the outer sheet and the fold axes of the inner sheets.

5. A method of producing a booklet, the booklet including an outer sheet and a plurality of inner sheets nested together, each sheet having a respective thickness, the outer sheet having a length in a specific direction, and a fold axis of the outer sheet being defined in the center of the outer sheet in the specific direction, the method comprising:

providing a stacker with a sheet support and a ramp set at an adjustable ramp angle to the sheet support;

using a processor to calculate the ramp angle of the stacker using the thicknesses of the sheets, and automatically setting the ramp angle of the stacker to the calculated ramp angle;

selecting an inner sheet;

selectively printing a print image on the selected inner sheet using a print engine;

automatically folding the outer sheet along its fold axis;

using the processor to determine a cut length and a fold axis position of the selected inner sheet, so that a fold axis of the selected inner sheet is defined at the fold axis position of the inner sheet along the specific direction;

repeating the selecting through determining steps for each sheet in the booklet;

automatically stacking the outer sheet and the plurality of inner sheets on the stacker, so that the respective fold axes of all sheets are disposed along the same normal to the sheet support; and using a fastening unit to fasten the fold axes of the stacked sheets together.

6. The method of claim 5, further comprising automatically folding the sheets along their fold axes to produce the booklet.

7. The method according to claim 5, further including printing a cover print image on the outer sheet.

* * * * *